US010695920B2

(12) United States Patent
Bruhns

(10) Patent No.: US 10,695,920 B2
(45) Date of Patent: Jun. 30, 2020

(54) FOLDING KNIFE

(71) Applicant: Hogue Tool & Machine, Inc., Paso Robles, CA (US)

(72) Inventor: James David Bruhns, Templeton, CA (US)

(73) Assignee: HOGUE TOOL & MACHINE, INC., Paso Robles, CA (US)

( * ) Notice: Subject to any disclaimer, the term of this patent is extended or adjusted under 35 U.S.C. 154(b) by 28 days.

(21) Appl. No.: 16/015,523

(22) Filed: Jun. 22, 2018

(65) Prior Publication Data

US 2018/0297218 A1 Oct. 18, 2018

Related U.S. Application Data

(63) Continuation of application No. 15/356,428, filed on Nov. 18, 2016, now Pat. No. 10,035,272.

(60) Provisional application No. 62/294,104, filed on Feb. 11, 2016.

(51) Int. Cl.
*B26B 1/04* (2006.01)
*B26B 1/02* (2006.01)

(52) U.S. Cl.
CPC ..... *B26B 1/044* (2013.01); *B26B 1/02* (2013.01); *B26B 1/046* (2013.01)

(58) Field of Classification Search
CPC ..... B26B 1/044; B26B 1/02; B26B 1/046
See application file for complete search history.

(56) References Cited

U.S. PATENT DOCUMENTS 4,190,953 A * 3/1980 Naifeh ..... B26B 1/02 30/155
4,352,633 A * 10/1982 Tassen ..... F03D 7/0224 416/137
4,896,424 A * 1/1990 Walker ..... B26B 1/044 30/161
5,440,813 A * 8/1995 Roskam ..... B26B 13/285 30/254
5,546,662 A * 8/1996 Seber ..... B26B 1/044 30/160

(Continued)

OTHER PUBLICATIONS

XIUXIU1313, "Talking About Detent Balls (How do they work?)," https://youtu.be/TYsnQrGg6TY, May 25, 2013, Accessed Jul. 28, 2016.

(Continued)

*Primary Examiner* — Sean M Michalski
(74) *Attorney, Agent, or Firm* — Bennet K. Langlotz; Langlotz Patent & Trademark Works, LLC

(57) ABSTRACT

A folding knife has an elongated frame defining a major plane and having a pivot element at a pivot end and defining a pivot axis and the frame defining a blade receptacle, an elongated blade occupying the major plane having a tip end and a base end, a spine edge and a cutting edge, and opposed major faces, the base end connected to the pivot element, the blade being operable to pivot between a stowed position in which the blade is received in the blade receptacle and an extended position in which the tip end of the blade extends away from the frame, and the blade having a lock feature proximate the base end, a button lock element connected to the frame proximate the pivot element and operable to selectably engage the lock feature when the blade is in the extended position.

45 Claims, 14 Drawing Sheets

(56) References Cited

U.S. PATENT DOCUMENTS 8,893,389 B2 * 11/2014 Freeman ..... B26B 1/046 30/155
9,120,234 B2 9/2015 MacNair et al.
2001/0039735 A1 * 11/2001 Neveux ..... B26B 1/046 30/161
2003/0136004 A1 * 7/2003 Scarla ..... B26B 1/02 30/160
2006/0230620 A1 * 10/2006 Steigerwalt ..... B26B 1/02 30/159
2007/0068000 A1 * 3/2007 Onion ..... B26B 1/02 30/160
2007/0169355 A1 * 7/2007 Lake ..... B26B 1/044 30/160
2008/0307656 A1 * 12/2008 Lin ..... B26B 1/044 30/159
2009/0271989 A1 * 11/2009 VanHoy ..... B26B 1/044 30/159
2012/0017443 A1 * 1/2012 Hao ..... B26B 1/046 30/161
2014/0259686 A1 * 9/2014 Garavaglia ..... B26B 1/046 30/156
2014/0360023 A1 * 12/2014 Lake ..... B26B 1/044 30/161
2015/0101197 A1 * 4/2015 Feng ..... B26B 1/02 30/155
2015/0367520 A1 * 12/2015 MacNair ..... B26B 1/044 30/161
2016/0031096 A1 * 2/2016 Koenig ..... B26B 1/02 30/161
2017/0120463 A1 * 5/2017 Pelletier ..... B26B 5/003

OTHER PUBLICATIONS

KS Bladeworks, "How to set detent ball (how I do it)," https://youtu.be/7rdP0ekiFd4, May 18, 2014, Accessed Jul. 28, 2016.
Sugarcreek Forge, "How to make a Liner Lock 5," https://youtu.be/yb1EPYAwz3I, Feb. 24, 2013, Accessed Jul. 28, 2016.
Bladereviews.com, "Hogue EX01 Knife Review," https://youtu.be/t0KcB0DRoD4, Aug. 17, 2012, Accessed Jul. 28, 2016.
XIUXIU1313, "How Does a Button Lock on a Knife Work?," https://youtu.be/G0gvaJkQYEo, May 13, 2012, Accessed Jul. 28, 2016.
XIUXIU1313, Inside a Button Lock Folder (Both Manual and Auto), https://youtu.be/sDVHLMKZKIY, May 24, 2012, Accessed Jul. 28, 2016.

* cited by examiner

FOLDING KNIFE

CROSS-REFERENCE TO RELATED APPLICATION

This application is a Continuation of U.S. application Ser. No. 15/356,428 filed on Nov. 18, 2016, entitled "FOLDING KNIFE", which claims the benefit of U.S. Provisional Patent Application No. 62/294,104 filed on Feb. 11, 2016, entitled "FOLDING KNIFE," which is hereby incorporated by reference in its entirety for all that is taught and disclosed therein.

FIELD OF THE INVENTION

The present invention relates to knives, and more particularly to a folding knife that can be easily closed with one hand without placing fingers in the path of the closing blade and is tunable to ensure reliable blade opening.

BACKGROUND OF THE INVENTION

Liner lock knives are a popular style of folding pocket knives. "Liner lock" refers to a blade locking mechanism, which is a side-spring lock that can be opened and closed with one hand without repositioning the knife. The liner lock's lock bar abuts the tang of the blade in the open position to prevent the blade from closing. To release the lock, the user presses the lock bar back toward the handle side, which shifts the lock bar out of the way, enabling the blade to close. In the closed position, the lock bar rests alongside the handle and the blade, typically employing a ball detent to releasably secure the blade in the closed position. One serious disadvantage of liner lock flipper knives is that the user must place his or her fingers in the path of the closing blade in order to disengage the lock bar from the blade. A second disadvantage is it is difficult to make the ball detent strong enough to securely hold the blade closed, but not so strong that the knife is difficult to open.

Button lock knives are another popular style of folding pocket knives. "Button lock" refers to a small push-button that locks the blade in the open position by blocking the blade against a stop such as a pin. By pressing the lock button toward the midline of the knife, the blade is released and is permitted to pivot back to the closed position. The button lock also retains the knife in the closed position, but with much less force than when the blade is open.

Either of these locking mechanisms can be combined with a flipper pocket knife, which refers to the method of folding and unfolding the blade from the handle. These include a flipper tab, which is a protrusion of the blade that is presented normally to the user's index finger when the blade is in the fully closed position. While in this state, the flipper tab enables the user to build enough energy prior to overcoming the resistance provided by the closure retention mechanism that the blade rapidly deploys once the user overcomes the resistance to opening. However, poor flipping technique or an overly weak detent often fail to provide the blade with enough energy to fully open, potentially resulting in unsafe blade opening.

While button lock flipper knives exist, they are not considered optimal or reliable because of weak closed detent retention. The resistance to opening is sufficiently weak that the blade will sometimes release with unintended or underpowered opening force, potentially resulting in unsafe blade opening.

Therefore, a need exists for a new and improved folding knife that can be easily closed with one hand without placing fingers in the path of the closing blade and is tunable to ensure reliable blade opening. In this regard, the various embodiments of the present invention substantially fulfill at least some of these needs. In this respect, the folding knife according to the present invention substantially departs from the conventional concepts and designs of the prior art, and in doing so provides an apparatus primarily developed for the purpose of being easily closed with one hand without placing fingers in the path of the closing blade and tunable to ensure reliable blade opening.

SUMMARY OF THE INVENTION

The present invention provides an improved folding knife, and overcomes the above-mentioned disadvantages and drawbacks of the prior art. As such, the general purpose of the present invention, which will be described subsequently in greater detail, is to provide an improved folding knife that has all the advantages of the prior art mentioned above.

To attain this, the preferred embodiment of the present invention essentially comprises. an elongated frame defining a major plane and having a pivot element at a pivot end and defining a pivot axis and the frame defining a blade receptacle, an elongated blade occupying the major plane having a tip end and a base end, a spine edge and a cutting edge, and opposed major faces, the base end connected to the pivot element, the blade being operable to pivot between a stowed position in which the blade is received in the blade receptacle and an extended position in which the tip end of the blade extends away from the frame, the blade having a lock feature proximate the base end, a button lock element connected to the frame proximate the pivot element and operable to selectably engage the lock feature when the blade is in the extended position, a detent element connected to the frame and having a detent feature biased against a major face of the blade, and the major face of the blade including a detent engagement feature registered with the detent feature and operable for engagement with the detent feature when the blade is in the folded position to resist opening the blade in response to a force less than a preselected threshold. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
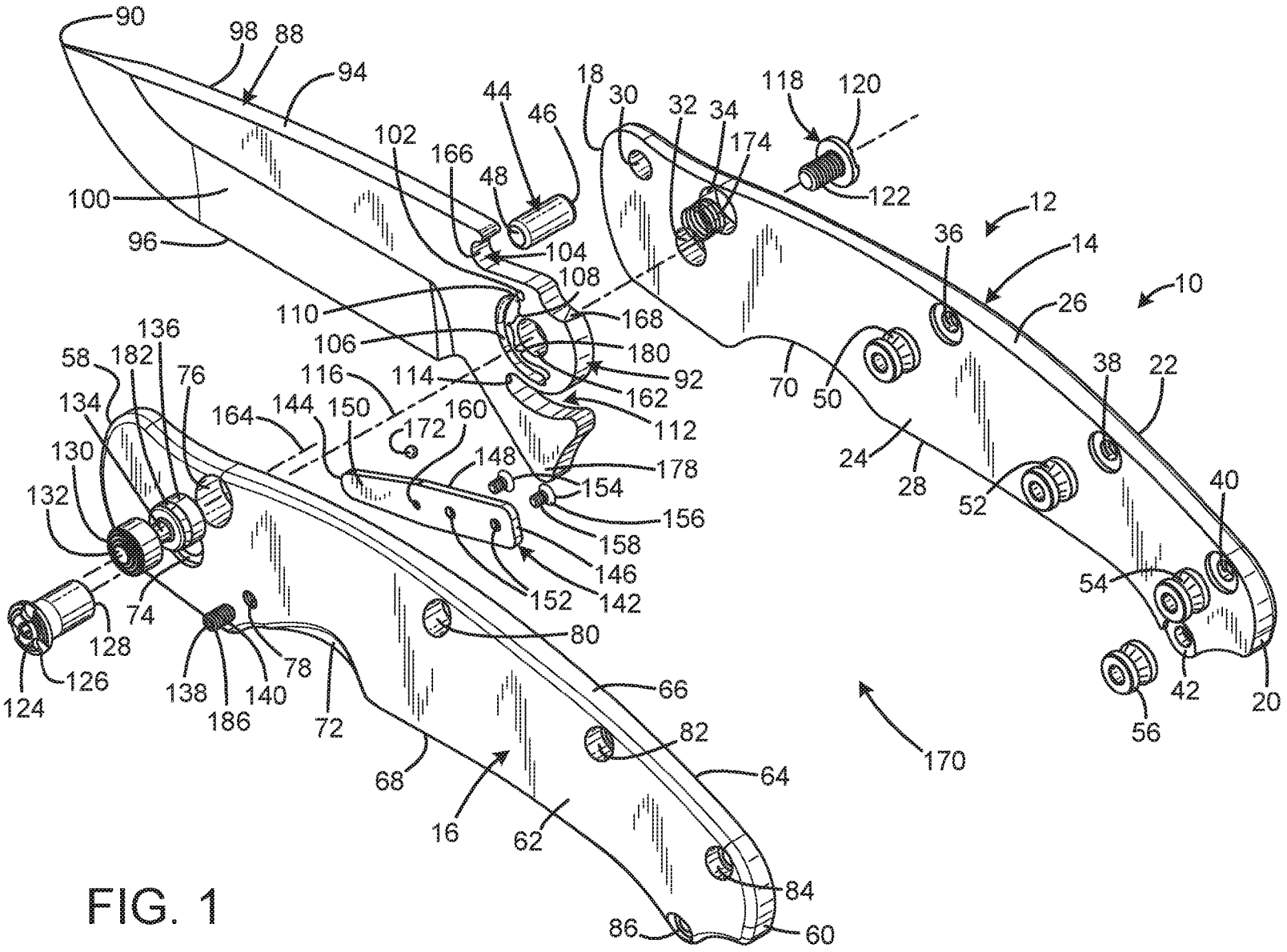
FIG. 1 is an exploded view of the current embodiment of the folding knife constructed in accordance with the principles of the present invention.

An embodiment of the folding knife of the present invention is shown and generally designated by the reference numeral 10.

Figure 2:
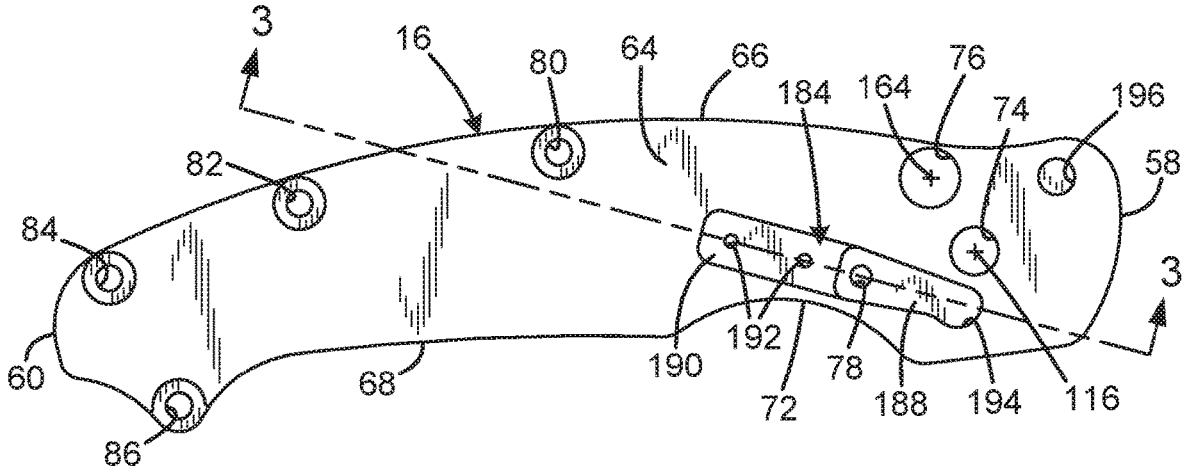
FIG. 2 is a right side view of the current embodiment of the left frame of the folding knife of FIG. 1.
Figure 3:
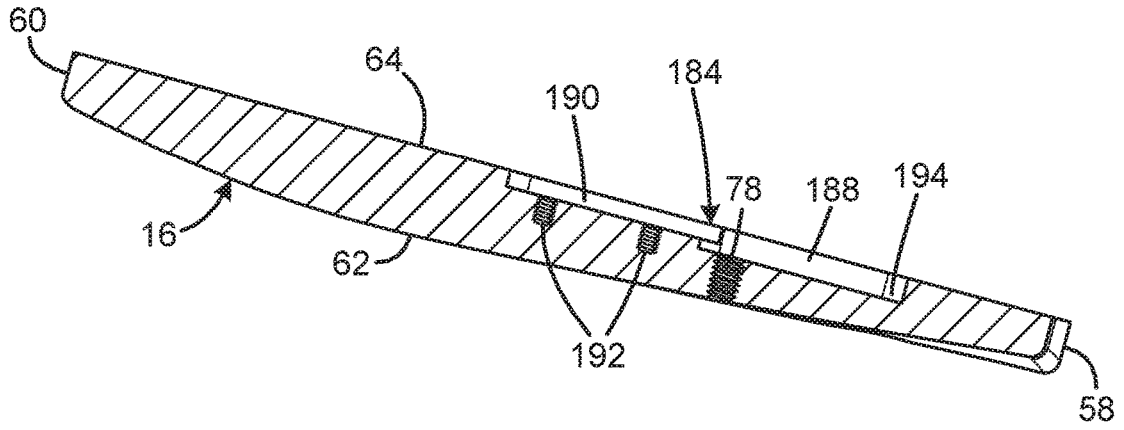
FIG. 3 is a sectional view taken along line 3-3 of FIG. 2.
Figure 4:
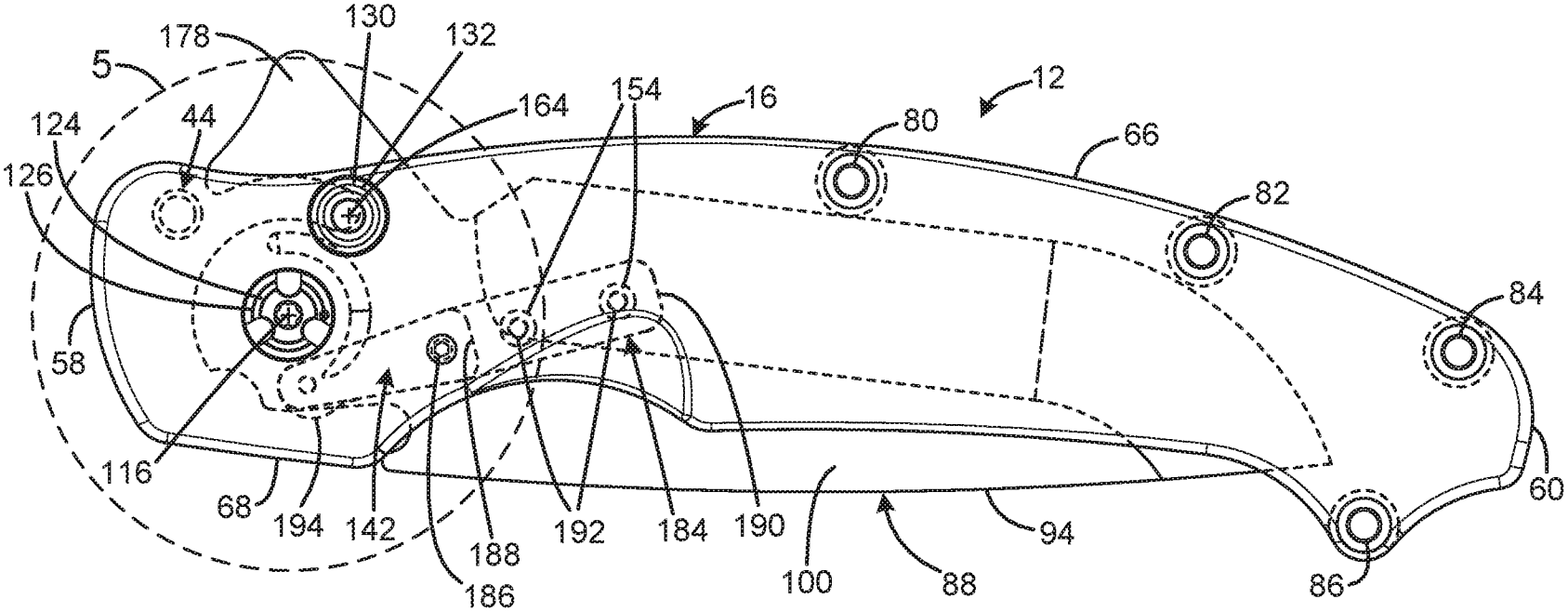
FIG. 4 is a left side view of the folding knife of FIG. 1 with the blade in the fully closed position.

FIGS. 1-3 illustrate the improved folding knife 10 of the current invention. More particularly, the folding knife has an elongated frame 12 defining a major plane and having a right frame 14 and a left frame 16. The right frame has a front 18, rear 20, exterior 22, interior 24, top 26, and bottom 28. The front of the right frame defines a stop pin recess 30, a pivot aperture 32, and a button aperture 34 that receives a button insert 176. The top of the right frame defines spacer apertures 36, 38, and 40, and the bottom rear of the right frame defines a spacer aperture 42. The bottom front of the right frame defines a recess 70 that accommodates the user's index finger when the knife is held in the fully opened position.

The left frame 16 has a front 58, rear 60, exterior 62, interior 64, top 66, and bottom 68. The front of the left frame defines a stop pin recess 196, a pivot aperture 74, a button aperture 76, and a tension adjustment screw aperture 78. The top of the left frame defines spacer apertures 80, 82, and 84, and the bottom rear of the left frame defines a spacer aperture 86. The bottom front of the left frame defines a recess 72 that accommodates the user's index finger when the knife is held in the fully opened position. The front interior of the left frame defines a spring plate pocket 184. The spring plate pocket has a relatively deep front portion 188 and a relatively shallow rear portion 190. The front portion includes an arcuate enlarged portion 194 to provide machining clearance. The rear portion includes two screw mounting holes 192.

A stop pin 44 has a right end 46 received within the stop pin recess 30 and a left end 48 received within the stop pin recess 196 in the left frame 16. Spacer 50 is received within spacer apertures 36 and 80, spacer 52 is received within spacer apertures 38 and 82, spacer 84 is received within spacer apertures 40 and 84, and spacer 56 is received within spacer apertures 42 and 86. Bolts (not shown) pass through the spacer apertures and spacers to threadedly secure the right frame 14 to the left frame.

A blade 88 is pivotally received within a blade receptacle 170 defined by an elongated channel located between the right frame 14 and the left frame 16. The blade has a tip end 90, a base end or tang 92, a spine edge 94, a cutting-edge 96, a right face 98, and a left face 100. The left face of the tang defines a recess 102 and a groove 106 separated by a flat portion 110. The groove is an arcuate track centered on a pivot axis 116. The groove includes an initial assistance segment 108 that is a ramp and a drag relief portion 180 that has a consistent depth in the current embodiment. The top of the tang defines a stop pin channel 104 with a forward travel limit 166 and a rearward lock button scallop 168. The bottom of the tang includes a downwardly-protruding flipper tab 178, which is triangular in the current embodiment. The bottom of the tang also defines a lock button channel 112 with a forward travel limit 114. A central pivot aperture 162 in the tang defines the pivot axis. A pivot screw 118 having a head 120 and a threaded end 122 passes through the pivot aperture 32 in the right frame 14 and is threadedly engaged with a threaded receptacle 128 on a pivot pin 124 having a head 126 that is inserted into pivot aperture 74 in the left frame. The pivot screw and pivot pin combine to form a pivot element located at a pivot end of the frame 12.

A manual lock button 130 having a left button element 132, a shaft 134, and a right button element 136 is inserted into the button aperture 76 in the left frame 16 and the button aperture 34 in the right frame 12. The button aperture in the right frame receives a button insert 176 that receives the outer portion of the right button element and the right end of a button coil spring 174. The button coil spring biases the lock button to a locked position in which a portion of the left button element protrudes from the left frame through the left frame's button aperture. The manual lock button reciprocates along a lock axis 164 that is perpendicular to the major plane defined by the frame 12. In the current embodiment, the right button element includes an inner chamfered portion 182, and the outer portion of the right button element includes a recess (not visible) that receives the left end of the button coil spring. The inner chamfered portion is a contact face parallel to the major plane defined by the frame 12 and adapted to contact the major right face 98 of the blade when the blade is in the stowed or closed position, such that the right button element does not generate resistance to opening the knife 10. The contact face of the right button element contacts the major right face of the blade throughout the blade's range of motion, except in the fully opened position.

Figure 5:
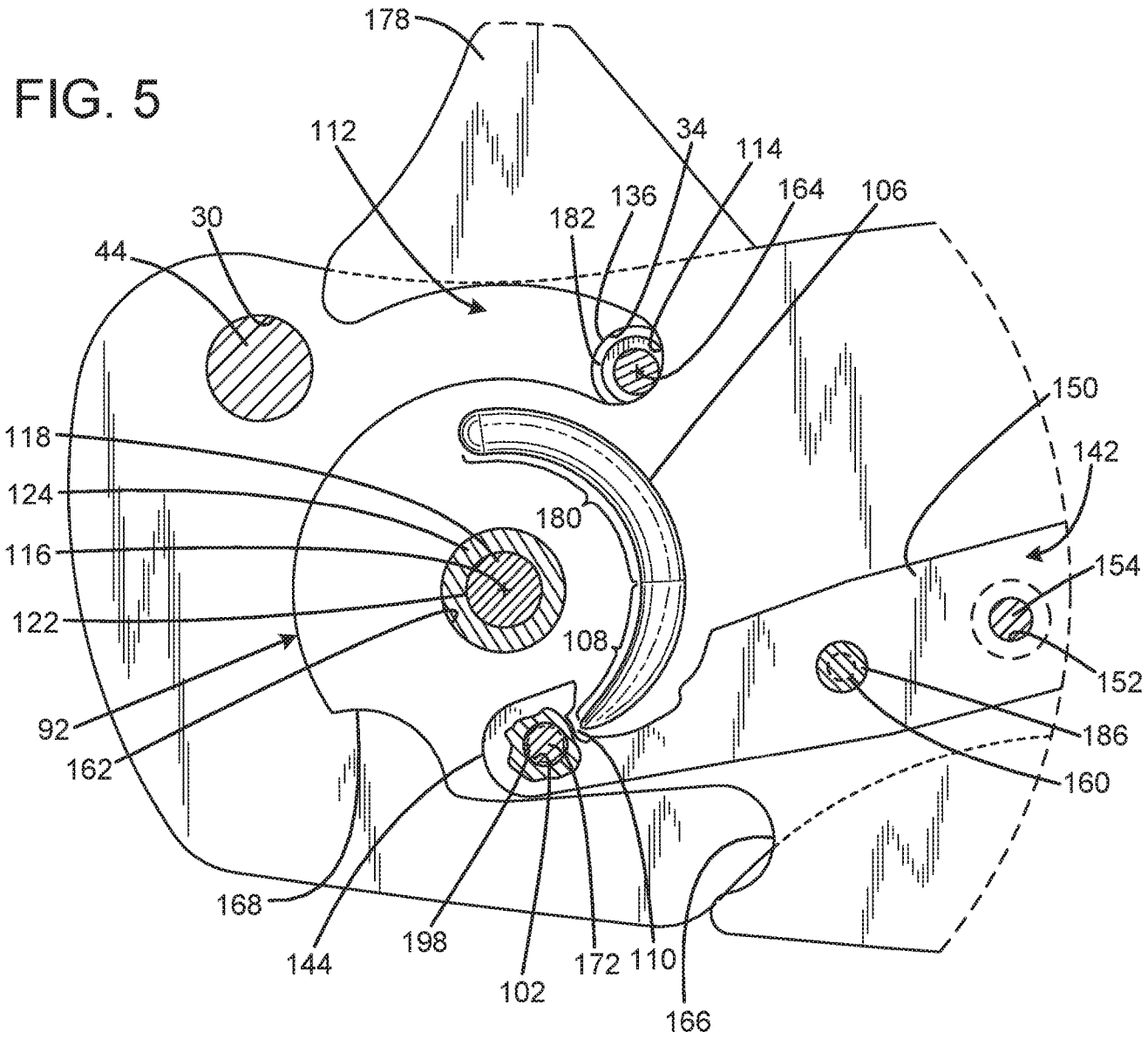
FIG. 5 is an enlarged view of the circled area 5 of FIG. 4.
Figure 6:
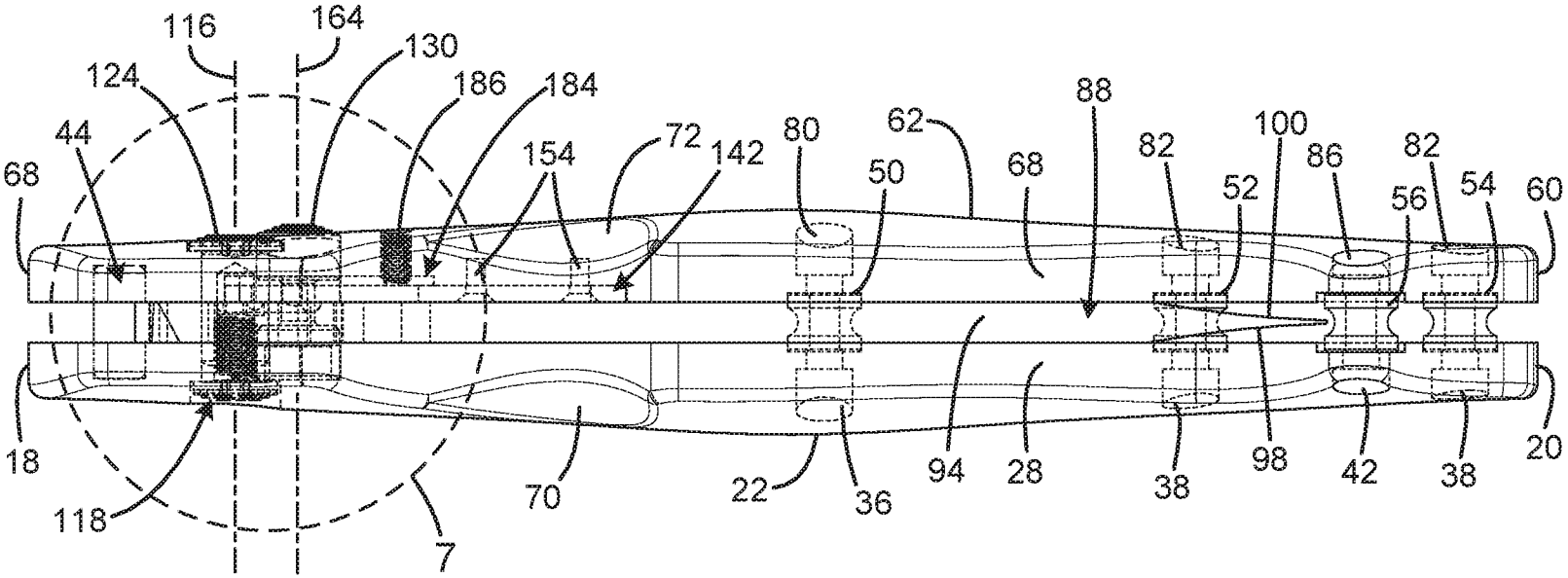
FIG. 6 is a bottom view of the folding knife of FIG. 1 with the blade in the fully closed position.
Figure 7:
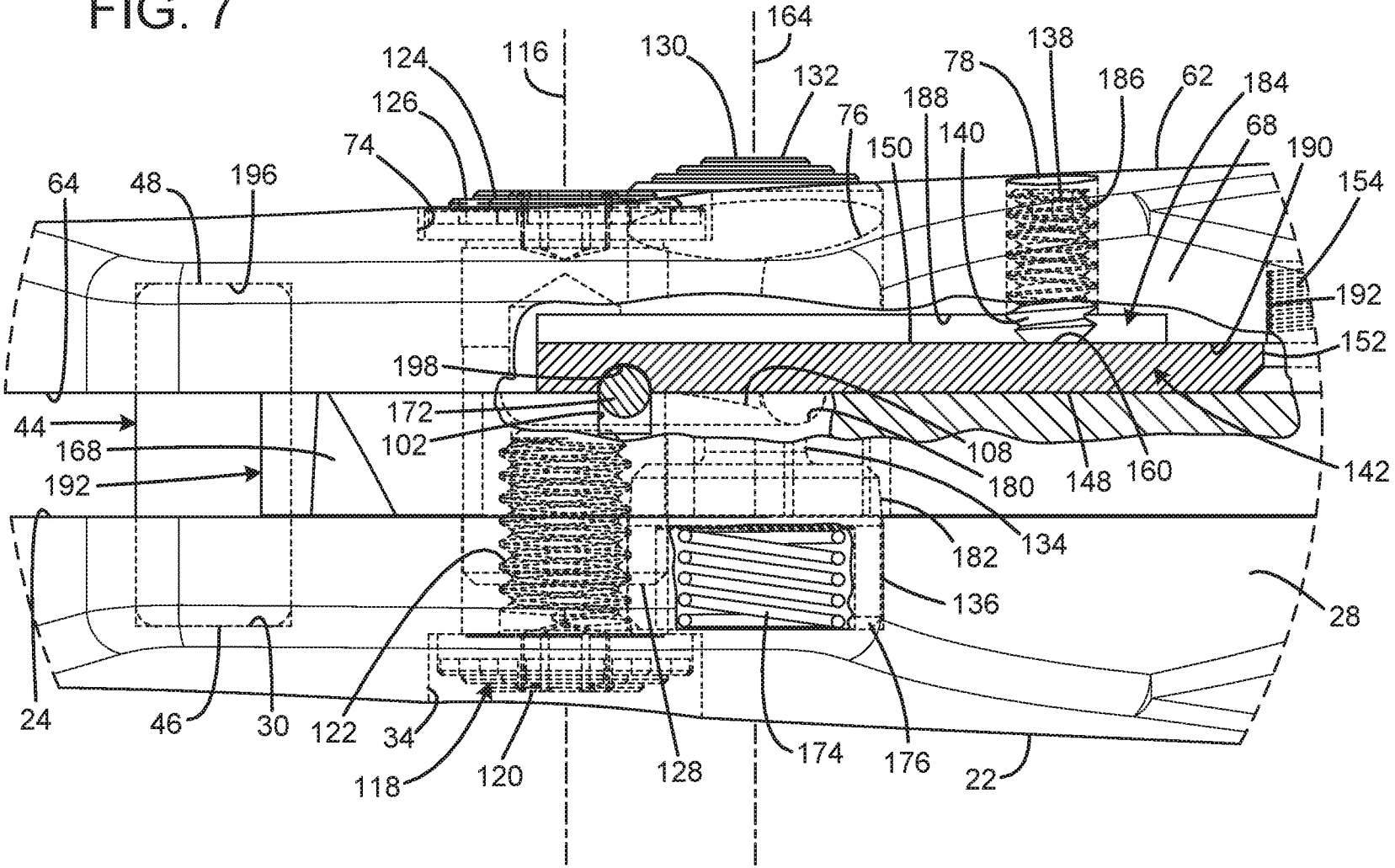
FIG. 7 is an enlarged view of the circled area 7 of FIG. 6.
Figure 8:
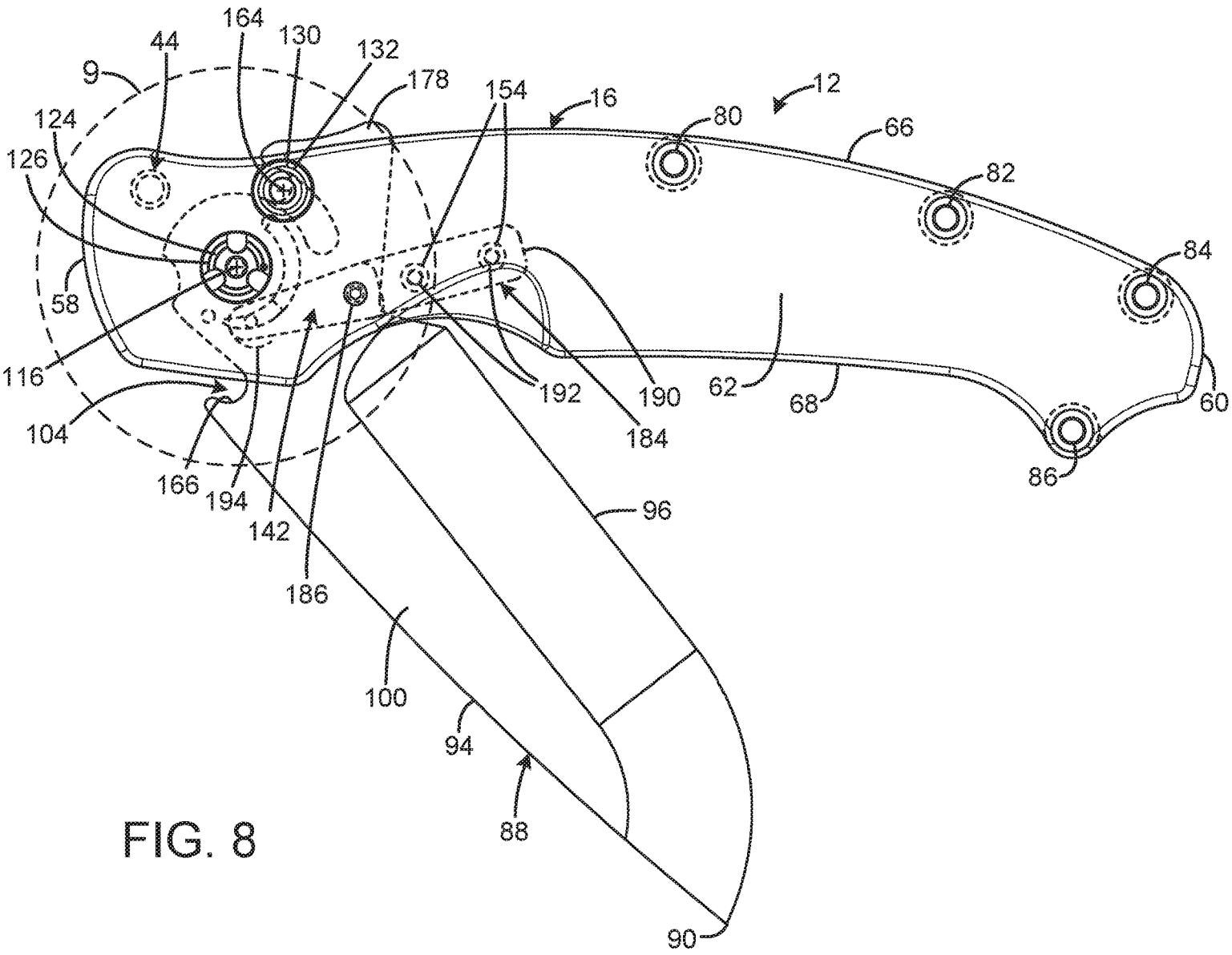
FIG. 8 is a left side view of the folding knife of FIG. 1 with the blade in the partially opened position.
Figure 9:
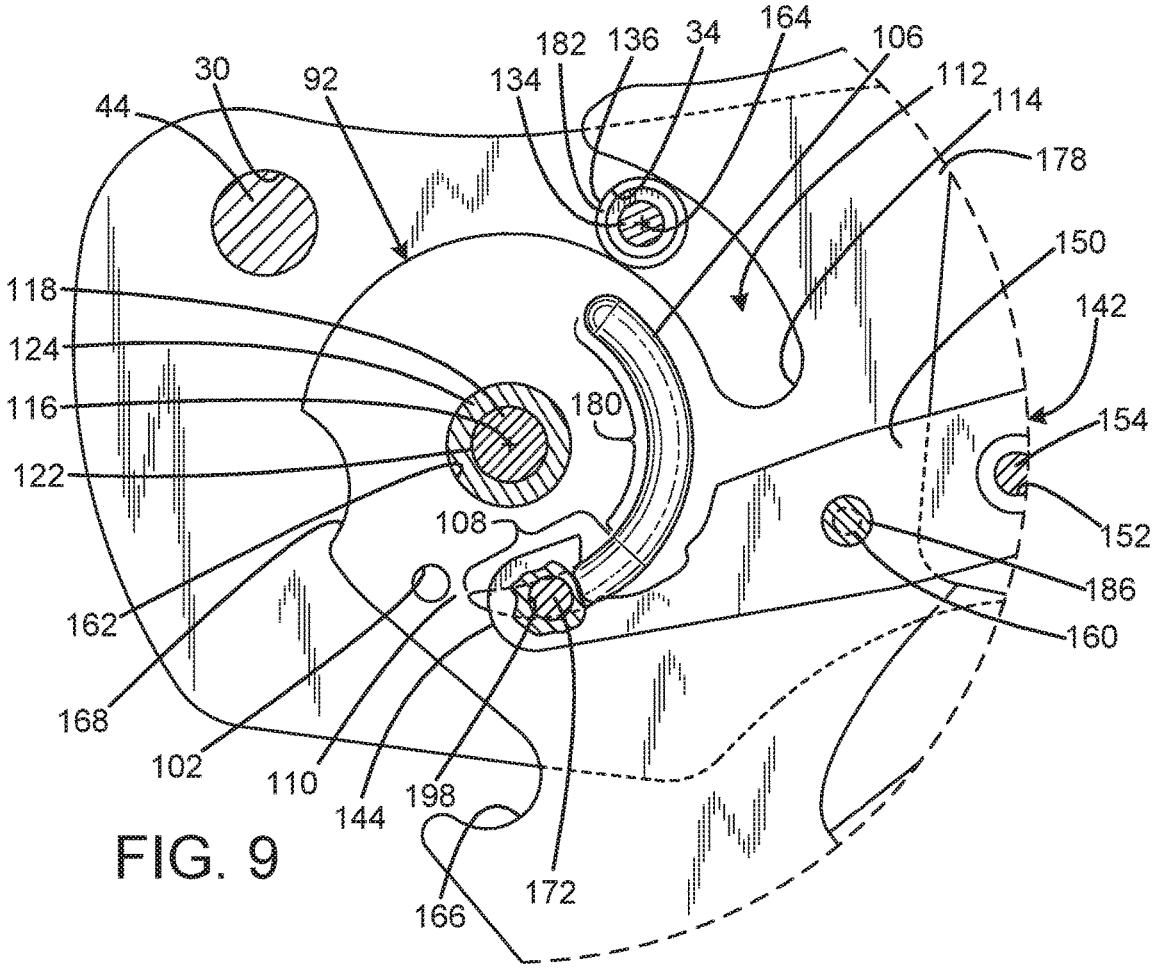
FIG. 9 is an enlarged view of the circled area 9 of FIG. 8.
Figure 10:
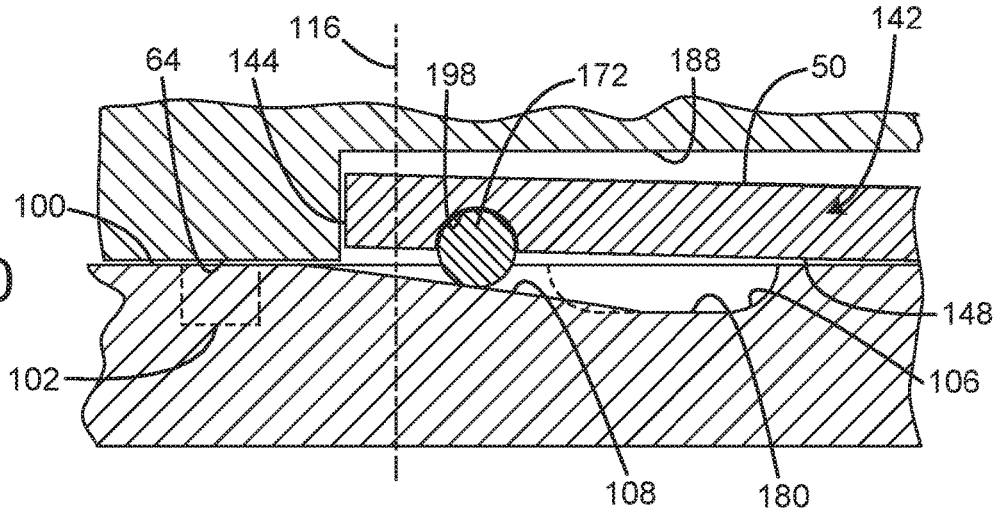
FIG. 10 is an enlarged bottom view of the circled area 9 of FIG. 8 showing the spring plate, ball, and the tang of the blade.
Figure 11:
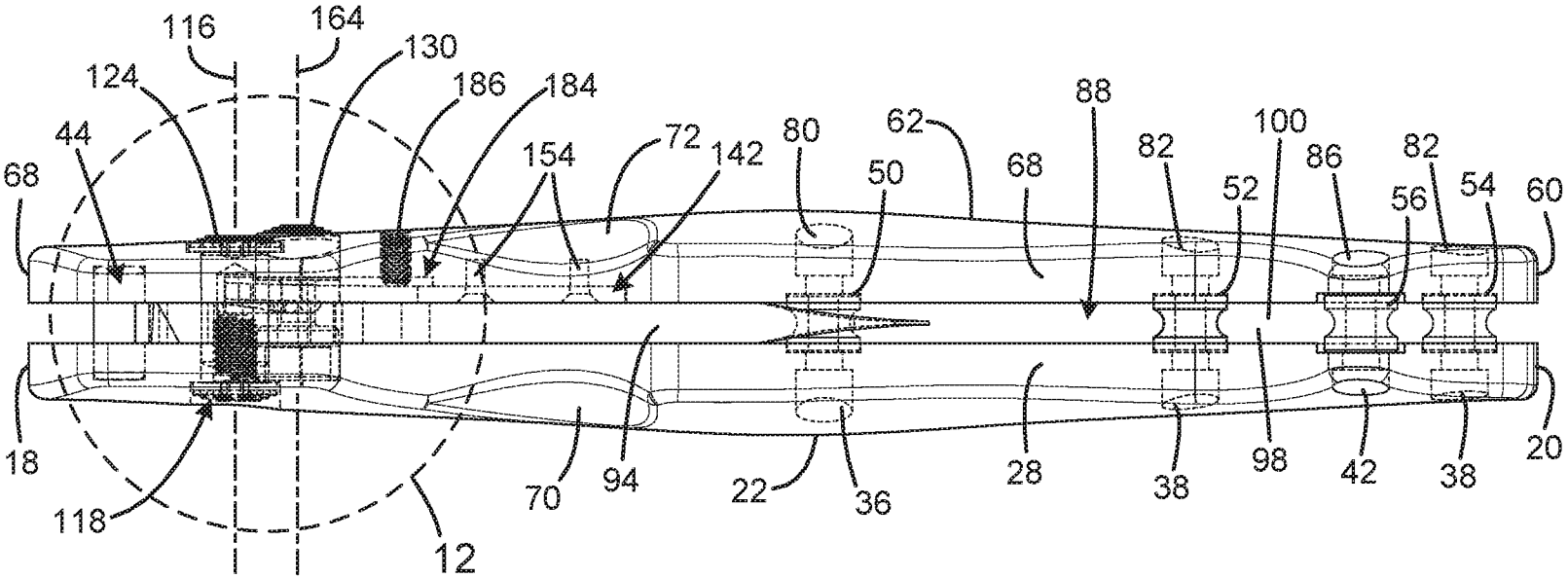
FIG. 11 is a bottom view of the folding knife of FIG. 1 with the blade in the partially opened position.
Figure 12:
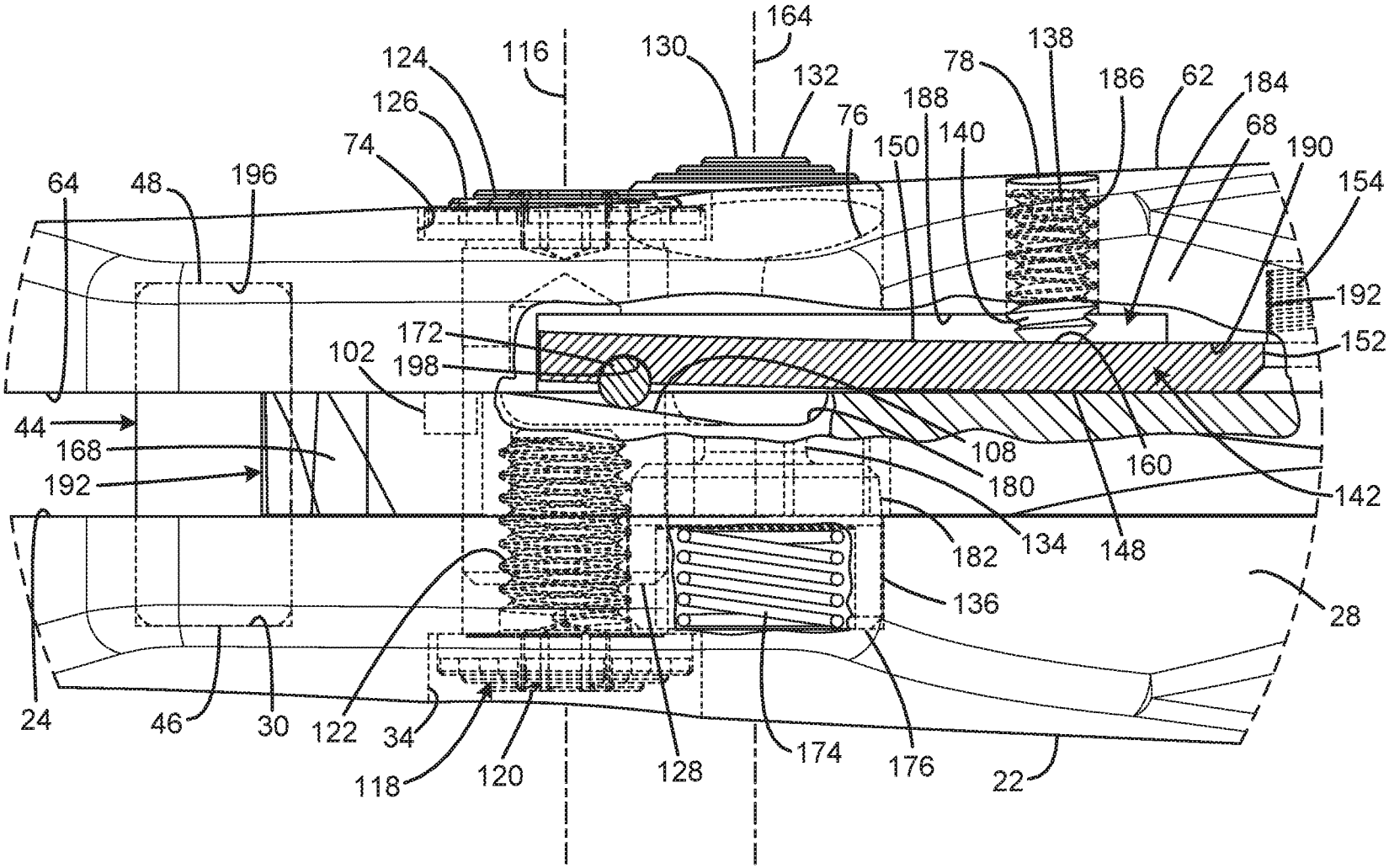
FIG. 12 is an enlarged view of the circled area 12 of FIG. 11.
Figure 13:
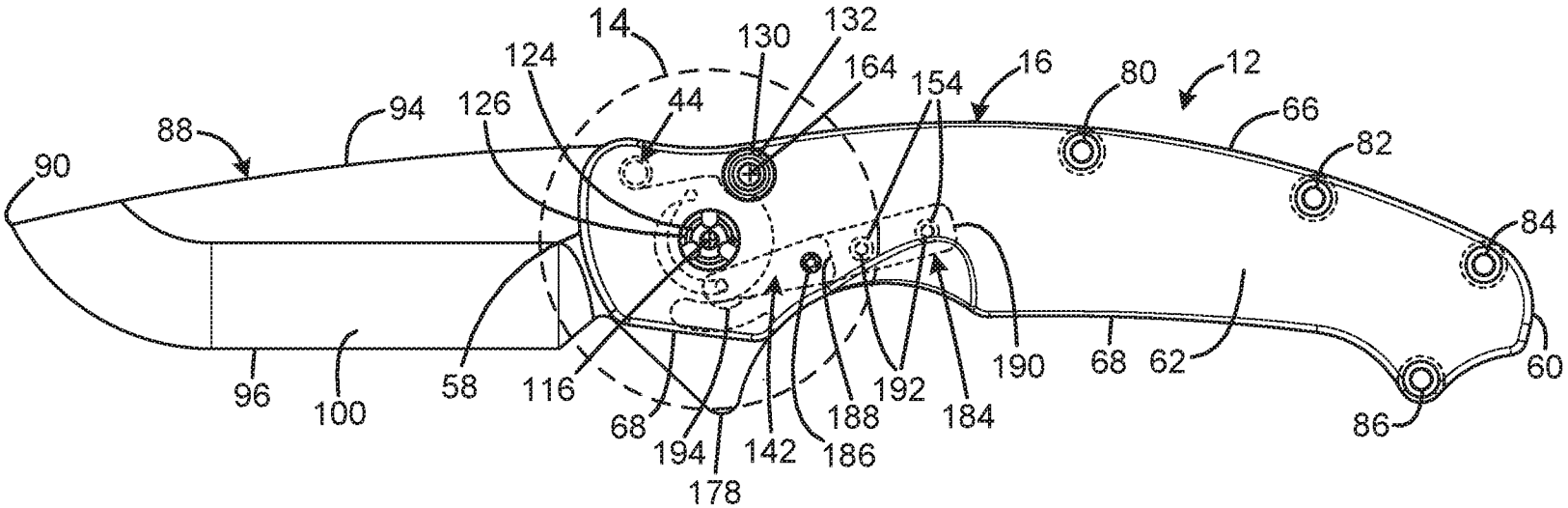
FIG. 13 is a left side view of the folding knife of FIG. 1 with the blade in the fully opened position.
Figure 14:
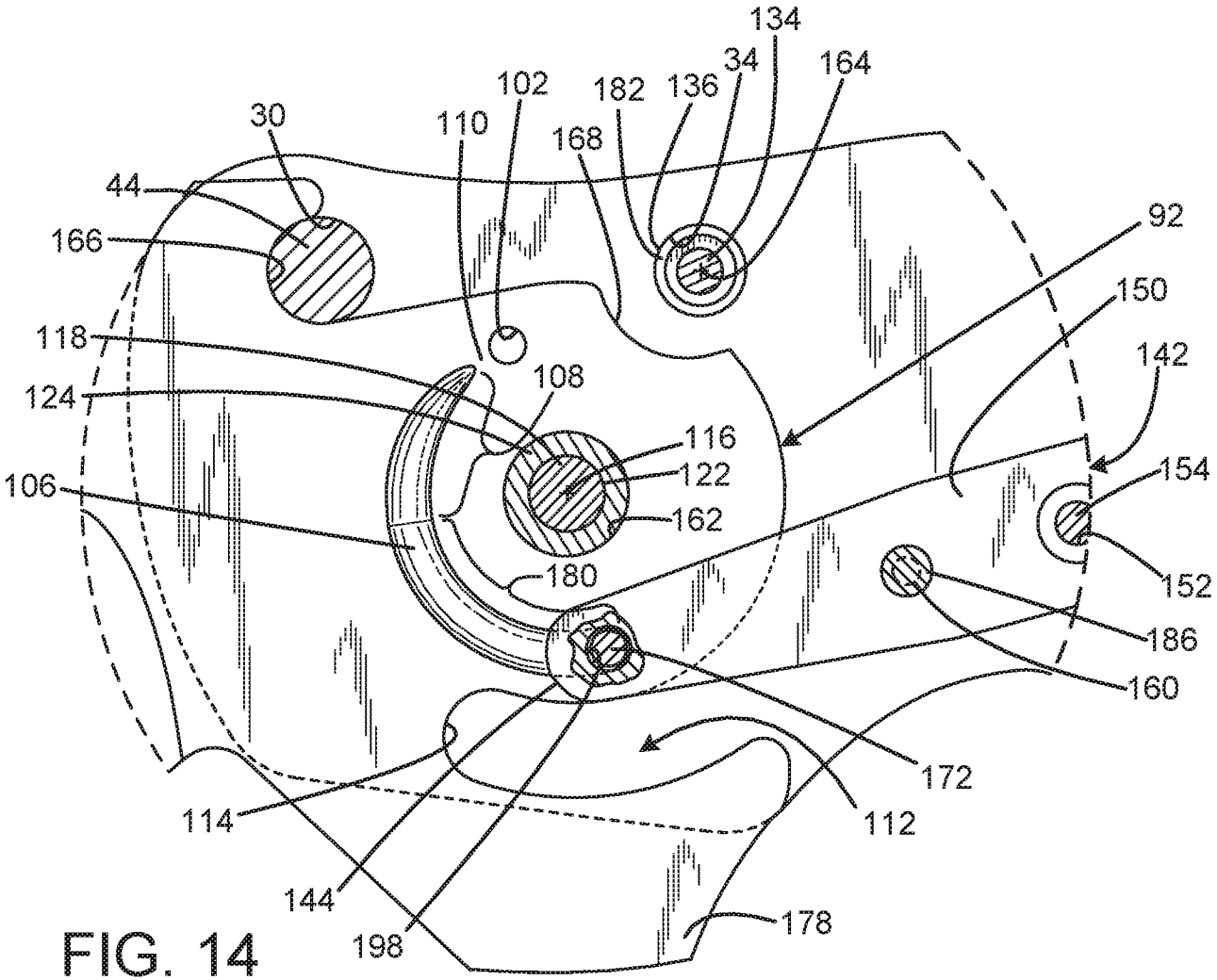
FIG. 14 is an enlarged view of the circled area 14 of FIG. 13.
Figure 15:
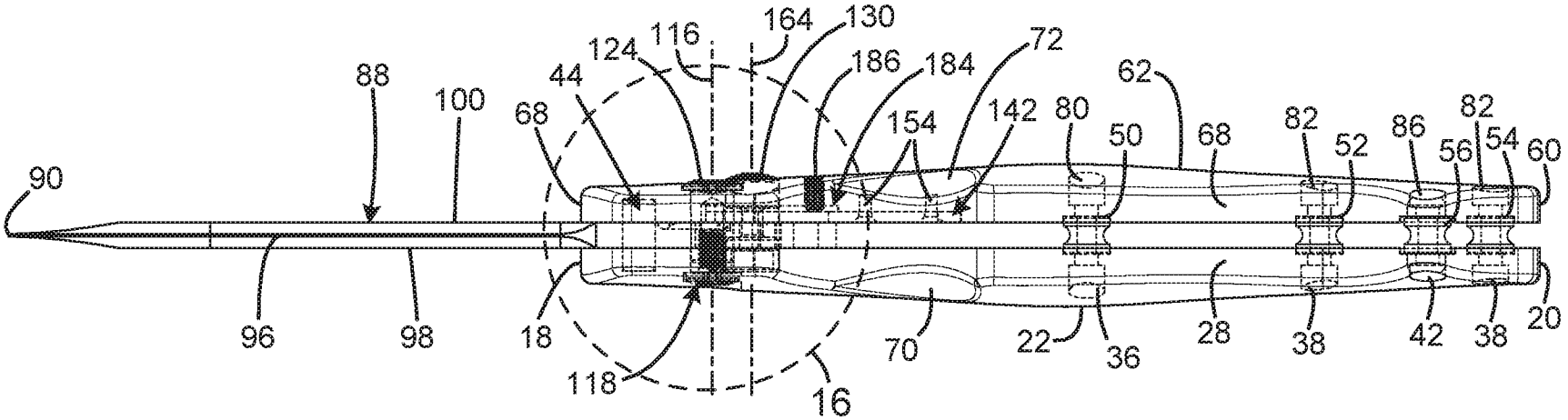
FIG. 15 is a bottom view of the folding knife of FIG. 1 with the blade in the fully opened position.
Figure 16:
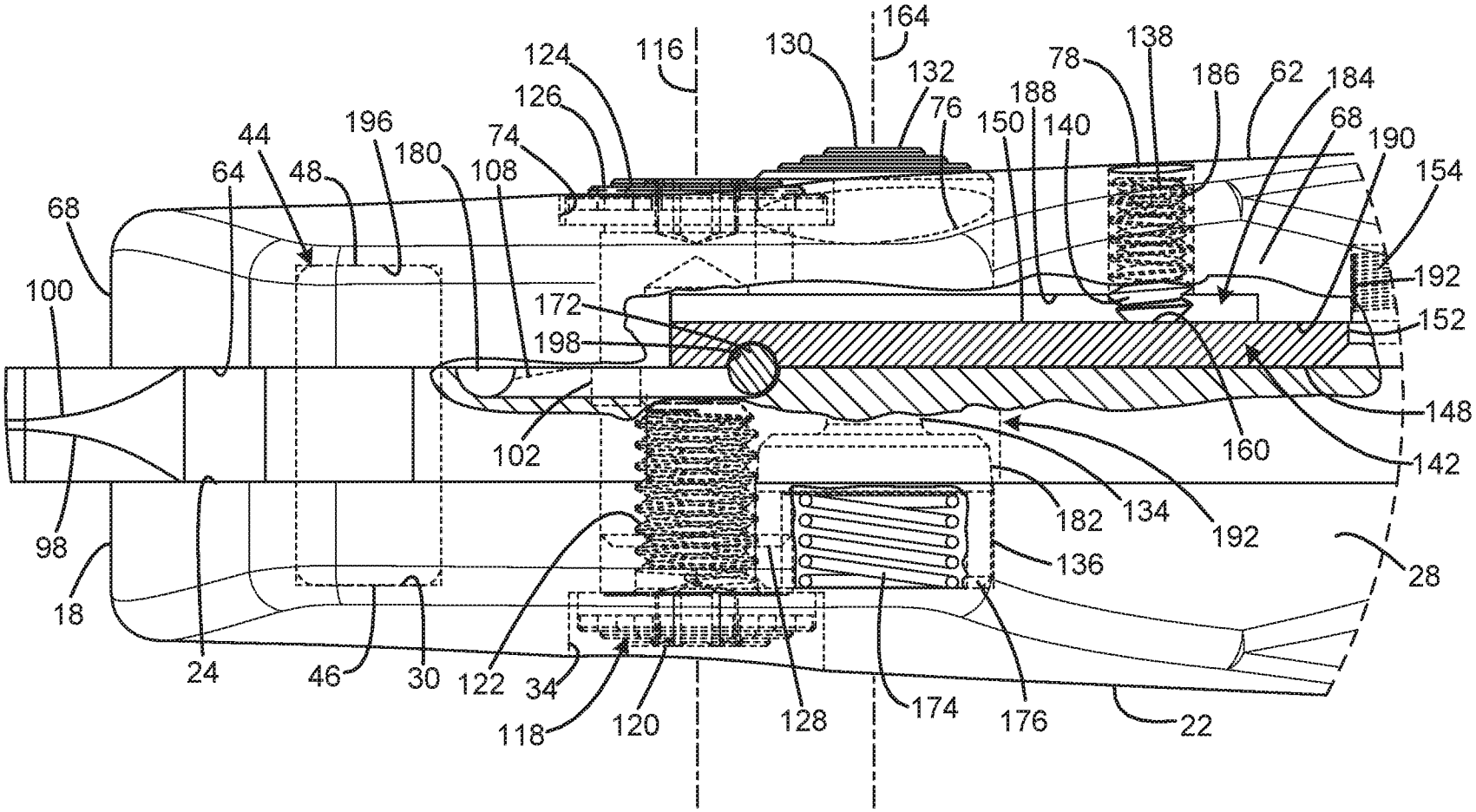
FIG. 16 is an enlarged view of the circled area 16 of FIG. 15.

A tension adjustment screw 186 having an adjustment socket 138 and a threaded end 140 is threadedly received within the tension adjustment screw aperture 78 in the left frame 16. The threaded end of the tension adjustment screw contacts the left face of a spring plate 142 at location 160. The tensioning screw is an optional element that provides enhanced control. The spring plate is made of tempered stainless steel and has a 0.062" major thickness. The tuned end encompassing location 160 can be reduced in thickness based on the desired tension. This condition may vary based on blade 88 size and weight so that optimum retention and deployment can be achieved. The spring plate also has a front 144, rear 146, and right face 148. The rear of the spring plate defines two screw apertures 152 that receive the threaded ends 158 of two screws 154 having heads 156. The screws are threadedly received within screw mounting holes 192 to secure the rear of the spring plate within the rear portion 190 of the spring plate pocket 184 in the interior 64 of the left frame. The rear portion of the spring plate pocket is sized to closely receive the rear of the spring plate. The front of the spring plate is received within the relatively deeper front portion 188 of the spring plate pocket, which makes the front of the spring plate free to flex outward into the front portion to the extent permitted by the threaded end of the tension adjustment screw. A ball 172 is retained within a pocket 198 (shown in FIG. 5) in the front of the right face of the spring plate, but the ball is registered with the groove 106 and a portion of the ball protrudes sufficiently to interact with the groove, flat portion 110, and recess 102 on the left face 100 of the tang 92. In the current embodiment, the ball is made of steel, as much as half of the steel ball is exposed, and the recess 102 on the tang 92 of the blade has the same diameter as the ball. In the current embodiment, the groove has a variable height such that force by the ball on the groove generates a selectable resistance or assistance to movement of the blade based on changes in the height of the groove. The initial assistance segment 108 is a ramp in which the surface of the groove falls away from the ball as the blade is initially opened from the stowed or closed position. The drag relief portion 180 of the groove is a low friction segment in which the ball is spaced apart from the groove. The low friction segment is aligned with the ball when the blade is in an intermediate position between the open position and the stowed position, and the open position.

In the current embodiment, the drag relief portion 180 must be deeper and wider than the ball 172 dimension and must provide clearance for the ball detent recess 102. The ball diameter is 0.0625" and protrudes from the right face 148 of the spring plate 142 by 0.031" in height. Therefore, the drag relief portion must be greater than 0.0625" in width and greater than 0.031" in depth to achieve this clearance. The initial assistance segment ramp 108 is necessary to bring the ball detent back to the side surface of the blade 88 under tension so the ball can then drop into the detent recess at the closed and retained position. The angle of the ramp is steep and short in the current embodiment to minimize the time and distance that the ball can drag on the side of the blade during rapid deployment. In the current embodiment, the ramp is 7° of rise which requires about ¼" of travel to rise out of the track.

FIGS. 4-7 illustrate the improved folding knife 10 of the current invention. More particularly, the blade 88 is shown in the stowed or fully closed position with the blade being received in the blade receptacle 170. Further counterclockwise pivoting of the blade is prevented by the engagement of the shaft 134 of the manual lock button 130 with the travel limit 114 in the lock button channel 112 of the tang 92. The portion of the ball 172 that protrudes from the right face 148 of the spring plate 142 is received within the recess 102 on the left face 100 of the tang, which prevents clockwise pivoting of the blade and unintended opening of the folding knife. In the closed and locked position, the front 144 of the spring plate is fully relaxed. The flipper tab 178 protrudes upward through the blade receptacle 170 above the top 26 of the right frame 14 and the top 66 of the left frame 16.

FIGS. 8-12 illustrate the improved folding knife 10 of the current invention. More particularly, the blade 88 is shown in the partially opened position with the blade having pivoted 128° clockwise about the pivot axis 116. To open the knife, the user applies sufficient downward and rearward force to the flipper tab 178 to displace the ball 172 from the recess 102 on the left face 100 of the tang 92. The blade pops open by pivoting clockwise about the pivot axis. There are no spacers or other obstacles present at the front of the frame 12 to prevent the flipper tab from travelling between the right frame 14 and left frame 16 through the blade receptacle to enable the tang of the blade to rotate about the pivot axis. As the blade continues to pivot clockwise, the ball travels over the flat portion 110 and fully flexes the front 144 of the spring plate outwards into the pocket 184 in the interior 64 of the left frame 14 to store energy. Subsequently, with further clockwise pivoting of the blade, the ball enters the ramp of the initial assistance segment 108 of the groove 106. As the ball travels down the ramp, additional energy is imparted to the blade as a wedging force as the front 144 of the spring plate 142 relaxes to ensure the blade will have sufficient momentum to reach the fully opened position without additional user intervention.

Once the ball 172 exits the initial assistance segment 108, the ball enters the drag relief portion 180 of the groove 106. The drag relief portion enables the front 144 of the spring plate 142 to relax fully since the protruding portion of the ball is received within the groove without making contact with the tang 92. The absence of contact with the tang eliminates drag or friction commonly experienced with conventional lock bar flipper knives, which can prevent full blade opening without additional user assistance.

FIGS. 13-16 illustrate the improved folding knife 10 of the current invention. More particularly, the blade 88 is shown in the extended or fully opened position with the tip end 90 of the blade extended away from the frame 12. Further clockwise pivoting of the blade is prevented by the engagement of the stop pin 44 with the travel limit 166 in the stop pin channel 104 of the tang 92. Counterclockwise or closing movement of the blade is prevented by selectable engagement of a button lock element connected to the frame 12 proximate the pivot element operable to engage a lock feature on the blade when the blade is in the extended position. Specifically, engagement of the chamfered portion 182 of the right button element 136 with the lock button scallop 168 prevents blade closure. The lock button scallop is sized such that the manual lock button 130 can be displaced to the left along the lock axis 164 by the button coil spring 174 until the chamfered portion is received within the lock button scallop and a portion of the left button element 132 protrudes through the button aperture 76 in the left frame 16. The manual lock button locks the blade 88 in the fully opened position until the manual lock button is pushed inward into the unlocked position by the user. An optional manual safety (not shown) can also be used to further secure the blade in the opened position.

To close the folding knife 10, the user applies sufficient inward force to the left button element 132 to compress the biasing element (button coil spring 174) between the right button element 136 and the button insert 176 and displace the right button element 136 outward to the right from the lock button scallop 168 on the tang 92. This enables the user to push the spine edge 94 of the blade 88 downward so the blade pivots in a counterclockwise direction about the pivot axis 116 to the partially opened position shown in FIGS. 4 and 5. Continued pressure applied to the spine edge of the blade eventually returns the blade to the fully closed position shown in FIGS. 2 and 3. The drag relief channel 180 and initial assistance segment ramp 108 portions of the groove 106 provide gradual and building resistance to closing of the blade as the spring plate 142 is flexed outward into the spring plate pocket 184 so the user is required to exert maximum closing pressure as the ball 172 crosses the flat portion 110 of the tang 92 just before the blade reaches the fully closed position. The subsequent engagement of the ball 172 with the recess 102 on the tang provides the user with a positive report that the blade has snapped or popped into the fully closed and retained position.

The folding knife 10 of the current invention can be precisely tuned to accommodate a variety of blade 88 lengths and weights so the blade reliably deploys into the fully opened position responsive to pressure being applied to the flipper tab 178 regardless of blade size or design.

Reliable deployment is achieved by precisely controlling the relationship between the tang 92 of the blade and the ball 172 protruding from the spring plate 142, which is a planar leaf spring in the current embodiment. Adding or subtracting thickness from the spring plate affects the amount of force required to flex the spring plate outward into the spring plate pocket 184. The tension adjustment screw 186 is an adjustment feature capable of adding or reducing resistance to flexing of the spring plate as desired by the end-user depending how far the threaded end 140 of the tension adjustment screw protrudes into the blade receptacle 170, which selects the position of the free front end 144 of the spring plate in the relaxed position. A ball detent relationship exists between the detent element (the spring plate) with its rear end 146 connected to the frame 12 and its front end supporting a detent feature (the ball) that is biased against a major (left face) of the blade and operable for engagement with a detent engagement feature (the recess 102) when the blade is in the folded position to resist opening the blade in response to a force less than a preselected threshold. The threshold (the amount of force that must be exerted upon the flipper tab to overcome the ball detent) can be carefully tuned with the tension adjustment screw so the blade does not open too easily or with too much difficulty, but sufficient energy is accumulated before the ball is displaced from the recess to subsequently flex the spring plate as the ball crosses the flat portion 110 of the tang 92 and rotate the blade clockwise until the ball enters the initial assistance segment ramp 108 of the groove 106. Once the ball enters the initial assistance segment ramp, energy imparted by relaxation of the spring plate as the ball travels down the ramp ensures rapid and reliable deployment of the blade into the fully opened position without additional user assistance.

The illustrated system may be used in conjunction with a liner lock folding knife, with the same features providing the retention in the closed position, the desired opening force, and the friction and force enhancements to provide reliable opening. The knife would instead be held locked open by the liner and not the button, and unlocking of the knife would be achieved by sliding aside the liner in the usual fashion instead of depressing the button.

While a current embodiment of a folding knife has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A folding knife comprising:

an elongated frame defining a major plane and having a pivot element at a pivot end and defining a pivot axis and the frame defining a blade receptacle;

an elongated blade parallel to the major plane having a tip end and a base end, a spine edge and a cutting edge, and opposed major faces, the base end connected to the pivot element;

the blade being operable to pivot between a stowed position in which the blade is received in the blade receptacle and an extended position in which the tip end of the blade extends away from the frame;

the blade having a lock feature proximate the base end;

a lock element connected to the frame proximate the pivot element and operable to selectably engage the lock feature when the blade is in the extended position;

a detent element connected to the frame and having a detent feature biased against a major face of the blade;

the major face of the blade including a detent engagement feature registered with the detent feature and operable for engagement with the detent feature when the blade is in the folded position to resist opening the blade in response to a force less than a preselected threshold; and wherein the blade has an arcuate track centered on the pivot axis, the track being registered with the detent feature, and the track having a variable height such that force by the detent feature on the track generates a variable resistance or assistance to movement of the blade based on changes in the height of the track.

2. The folding knife of claim 1 wherein the detent engagement feature of the blade is a recess in the blade.

3. The folding knife of claim 1 wherein the detent feature is a ball.

4. The folding knife of claim 1 wherein the detent element includes a spring having an adjustment feature to enable a spring biasing detent force of a selected amount.

5. The folding knife of claim 1 wherein the spring is a planar leaf spring having a free end supporting the detent feature and an opposed end attached to the frame.

6. The folding knife of claim 5 including an adjustment screw contacting the leaf spring and operable to select the position of the free end.

7. The folding knife of claim 1 wherein the track is a groove.

8. The folding knife of claim 1 wherein the track includes an initial assistance segment in which the surface of the track falls away from the detent feature as the blade is initially opened from the stowed position.

9. The folding knife of claim 1 where the track includes a low friction segment in which the detent feature is spaced apart from the track.

10. The folding knife of claim 9 wherein the low friction segment is aligned with the detent feature when the blade is in an intermediate position between the open position and the stowed position, and the open position.

11. The folding knife of claim 1 wherein the lock element reciprocates along a lock axis perpendicular to the major plane.

12. The folding knife of claim 1 wherein the lock element is biased by a biasing element to a locked position in which a portion of the lock element protrudes from the frame, and movable against a biasing force by pressure on the lock element to enable the blade to fold to the stowed position.

13. The folding knife of claim 1 wherein the lock element includes a contact face parallel to the major plane and adapted to contact a major face of the blade when the blade is in the stowed position.

14. The folding knife of claim 13 wherein the contact face of the lock element contacts the major face of the blade throughout the blade's range of motion.

15. A folding knife comprising:

an elongated frame defining a major plane and having a pivot element at a pivot end and defining a pivot axis and the frame defining a blade receptacle;

an elongated blade parallel to the major plane having a tip end and a base end, a spine edge and a cutting edge, and the base end connected to the pivot element;

the blade being operable to pivot between a stowed position in which the blade is received in the blade receptacle and an extended position in which the tip end of the blade extends away from the frame;

the blade having a lock feature proximate the base end;

a lock element connected to the frame proximate the pivot element and operable to selectably engage the lock feature when the blade is in the extended position;

a detent element connected to the frame and having a detent feature biased against the blade;

the blade including a detent engagement feature registered with the detent feature and operable for engagement with the detent feature when the blade is in the folded position to resist opening the blade in response to a force less than a preselected threshold, and wherein the detent element includes a detent spring operable independently of the lock element.

16. The folding knife of claim 15 wherein the detent engagement feature of the blade is a recess in the blade.

17. The folding knife of claim 15 wherein the detent feature is a ball.

18. The folding knife of claim 15 wherein the detent spring has an adjustment feature to enable a spring biasing detent force of a selected amount.

19. The folding knife of claim 15 wherein the spring is a planar leaf spring having a free end supporting the detent feature and an opposed end attached to the frame.

20. The folding knife of claim 19 including an adjustment screw contacting the leaf spring and operable to select the position of the free end.

21. The folding knife of claim 15 wherein the blade has an arcuate track centered on the pivot axis, the track being registered with the detent feature, and the track having a variable height such that force by the detent feature on the track generates a selectable resistance or assistance to movement of the blade based on changes in the height of the track.

22. The folding knife of claim 21 wherein the track is a groove.

23. The folding knife of claim 21 wherein the track includes an initial assistance segment in which the surface of the track falls away from the detent feature as the blade is initially opened from the stowed position.

24. The folding knife of claim 21 where the track includes a low friction segment in which the detent feature is spaced apart from the track.

25. The folding knife of claim 24 wherein the low friction segment is aligned with the detent feature when the blade is in an intermediate position between the open position and the stowed position, and the open position.

26. The folding knife of claim 15 wherein the lock element reciprocates along a lock axis perpendicular to the major plane.

27. The folding knife of claim 15 wherein the lock element is biased by a biasing element to a locked position in which a portion of the lock element protrudes from the frame, and movable against a biasing force by pressure on the lock element to enable the blade to fold to the stowed position.

28. The folding knife of claim 15 wherein the lock element includes a contact face parallel to the major plane and adapted to contact the blade when the blade is in the stowed position.

29. The folding knife of claim 28 wherein the contact face of the lock element contacts the blade throughout the blade's range of motion.

30. The folding knife of claim 15 wherein the lock element includes a lock spring separate from the detent spring.

31. The folding knife of claim 15 wherein the lock element is a button lock.

32. A folding knife comprising:

an elongated frame defining a major plane and having a pivot element at a pivot end and defining a pivot axis and the frame defining a blade receptacle;

an elongated blade parallel to the major plane having a tip end and a base end, a spine edge and a cutting edge, and the base end connected to the pivot element;

the blade being operable to pivot between a stowed position in which the blade is received in the blade receptacle and an extended position in which the tip end of the blade extends away from the frame;

the blade having a lock feature proximate the base end;

a lock element connected to the frame proximate the pivot element and operable to selectably engage the lock feature when the blade is in the extended position;

a detent element connected to the frame and having a detent feature biased against the blade;

the blade including a detent engagement feature registered with the detent feature and operable for engagement with the detent feature when the blade is in the folded position to resist opening the blade in response to a force less than a preselected threshold; and wherein the blade has an arcuate track centered on the pivot axis, the track being registered with the detent feature, and the track having a variable height suck that force by the detent feature on the track generates a variable resistance or assistance to movement of the blade based on changes in the height of the track.

33. The folding knife of claim 32 wherein the detent engagement feature of the blade is a recess in the blade.

34. The folding knife of claim 32 wherein the detent feature is a ball.

35. The folding knife of claim 32 wherein the detent element includes a spring having an adjustment feature to enable a spring biasing detent force of a selected amount.

36. The folding knife of claim 32 wherein the spring is a planar leaf spring having a free end supporting the detent feature and an opposed end attached to the frame.

37. The folding knife of claim 36 including an adjustment screw contacting the leaf spring and operable to select the position of the free end.

38. The folding knife of claim 32 wherein the track is a groove.

39. The folding knife of claim 32 wherein the track includes an initial assistance segment in which the surface of the track falls away from the detent feature as the blade is initially opened from the stowed position.

40. The folding knife of claim 32 where the track includes a low friction segment in which the detent feature is spaced apart from the track.

41. The folding knife of claim 40 wherein the low friction segment is aligned with the detent feature when the blade is in an intermediate position between the open position and the stowed position, and the open position.

42. The folding knife of claim 32 wherein the lock element reciprocates along a lock axis perpendicular to the major plane.

43. The folding knife of claim 32 wherein the lock element is biased by a biasing element to a locked position in which a portion of the lock element protrudes from the frame, and movable against a biasing force by pressure on the lock element to enable the blade to fold to the stowed position.

44. The folding knife of claim 32 wherein the lock element includes a contact face parallel to the major plane and adapted to contact the blade when the blade is in the stowed position.

45. The folding knife of claim 44 wherein the contact face of the lock element contacts the blade throughout the blade's range of motion.

* * * * *